US008943642B2

(12) United States Patent
Hasegawa et al.

(10) Patent No.: US 8,943,642 B2
(45) Date of Patent: Feb. 3, 2015

(54) CLEANING SHEET AND CLEANING TOOL

(75) Inventors: Satoshi Hasegawa, Kagawa (JP); Tomokazu Suda, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 268 days.

(21) Appl. No.: 13/513,104

(22) PCT Filed: Sep. 27, 2010

(86) PCT No.: PCT/JP2010/066694

§ 371 (c)(1),
(2), (4) Date: Aug. 6, 2012

(87) PCT Pub. No.: WO2011/067977

PCT Pub. Date: Jun. 9, 2011

(65) Prior Publication Data

US 2012/0311805 A1 Dec. 13, 2012

(30) Foreign Application Priority Data

Dec. 1, 2009 (JP) ..... 2009-273981

(51) Int. Cl.
*A47L 13/16* (2006.01)
*A47L 13/256* (2006.01)
(Continued)

(52) U.S. Cl.
CPC ..... *A47L 13/16* (2013.01); *A47L 13/256* (2013.01); *A47L 13/44* (2013.01); *A47L 13/20* (2013.01)
USPC ..... 15/228; 15/209.1; 15/231

(58) Field of Classification Search
CPC ..... A47L 13/256; A47L 13/20; A47L 13/16; A47L 13/44
USPC ..... 15/209.1, 228, 231, 246
See application file for complete search history.

(56) References Cited

U.S. PATENT DOCUMENTS 7,516,510 B2 * 4/2009 Tanaka ..... 15/228
2003/0045197 A1 * 3/2003 Kakiuchi et al. ..... 442/403
(Continued)

FOREIGN PATENT DOCUMENTS

EP 1 642 523 A2 4/2006
JP 10-014839 A 1/1998
(Continued)

OTHER PUBLICATIONS

International Search Report from corresponding PCT application No. PCT/JP2010/066694 dated Nov. 2, 2010 (5 pgs).
(Continued)

*Primary Examiner* — Shay Karls
(74) *Attorney, Agent, or Firm* — Brinks Gilson & Lione

(57) ABSTRACT

A cleaning sheet and a cleaning tool which have improved usability. The cleaning sheet is attachable to a cleaning-sheet mounting member. The cleaning sheet has a center section made up of a cleaning surface and at least one end section disposed at one or more sides with respect to the center section in a predetermined direction. The end section has a first portion having a first elongation percentage and a second portion having a second elongation percentage which is higher than that of the first portion. The second portion is disposed in said direction between the first portion and the center section and is constructed so as to be supported by the cleaning-sheet mounting member at the boundary between the first and second portions. The cleaning tool is provided with the cleaning sheet.

5 Claims, 9 Drawing Sheets

(51) Int. Cl.
*A47L 13/44* (2006.01)
*A47L 13/20* (2006.01)

(56) References Cited

U.S. PATENT DOCUMENTS

| | | | |
|---|---|---|---|
| 2006/0064834 | A1 | 3/2006 | Tanaka |
| 2012/0311805 | A1 | 12/2012 | Hasegawa et al. |

FOREIGN PATENT DOCUMENTS

| | | | |
|---|---|---|---|
| JP | 2007-020615 | A | 2/2007 |
| JP | 2008-161592 | A | 7/2008 |

OTHER PUBLICATIONS

International Preliminary Report on Patentability and Written Opinion from corresponding PCT application No. PCT/JP2010/066694 dated Jul. 19, 2012 (10 pgs).

Chinese First Office Action and English translation from corresponding Chinese Application No. 201080054499.4 dated Jan. 13, 2014 (12 pgs).

European extended Search Report from corresponding European Application No. 10 834 430.0 dated Apr. 8, 2014 (6 pgs).

* cited by examiner

CLEANING SHEET AND CLEANING TOOL

RELATED APPLICATION

This application is a 35 U.S.C. §371 national phase filing of International Patent Application No. PCT/JP2010/066694, filed Sep. 27, 2010, through which and to which priority is claimed under 35 U.S.C. §119 to Japanese Patent Application No. 2009-273981, filed Dec. 1, 2009.

FIELD OF THE INVENTION

The invention relates to cleaning sheets and cleaning tools, and more particularly to a cleaning sheets and cleaning tools which can be suitably used for wiping an object to be cleaned such as floor.

DESCRIPTION OF THE RELATED ART

Japanese non-examined laid-open Patent Publication No. 2007-20615 discloses a cleaning sheet having an inner layer sheet and outer layer sheets integrally formed with the inner layer sheet on both sides of the inner layer sheet. In use, the cleaning sheet can be attached to a cleaning sheet mounting member of a cleaning tool. Central portion of the cleaning sheet is placed on a cleaning side of the cleaning sheet mounting member. Both ends of the cleaning sheet are pushed in between holding members provided in the cleaning sheet mounting member and held between the holding members. According to the known cleaning sheet, low-hydroentangled part is provided with the central portion and high-hydoroentangled part is provided with ends of he cleaning sheet.

STATE OF THE ART

Patent Prior Art

Japanese non-examined laid-open Patent Publication No. 2007-20615

SUMMARY OF THE INVENTION

In operation of cleaning floor or other objects having a high frictional resistance, with a cleaning sheet attached to a cleaning sheet mounting member of a cleaning tool, a tensile stress acts upon the cleaning sheet in a direction opposite to the direction of movement of the cleaning sheet mounting member. According to the known cleaning sheet, the end portion of the sheet has substantially the same elongation rate across the entire region of the end portion. In this connection, when a tensile stress acts upon the cleaning sheet during cleaning operation and the elongation rate of the end portion is set as relatively low (namely, the rigidity of the end portion is relatively high), the ends of the cleaning sheet easily become detached from the holding members. On the other hand, when a tensile stress acts upon the cleaning sheet during cleaning operation and the elongation rate of the end portion is set as relatively high (namely, the rigidity of the end portion is relatively low), the ends of the cleaning sheet held by the holding member may be easily broken by the tensile stress. In this regard, the known cleaning sheet is in difficulty both to avoid unwilling detachment of the cleaning sheet and to secure rigidity for avoiding easy break of the cleaning sheet held by the holding member.

Accordingly, it is an object of the invention to enhance a usability of cleaning technique.

Above described object can be achieved by the claimed invention. According to the invention, a representative cleaning sheet is provided. The cleaning sheet is attachable to a cleaning sheet mounting member for cleaning operation. As a cleaning sheet, non-woven fabric sheet may preferably be utilized.

The cleaning sheet has a central portion which defines a cleaning face and at least one end portion formed at least one of both sides of the central portion in a predetermined direction. The end portion may preferably be provided only at one end of the central portion or at both ends of the central portion. The end portion has a first part having a predetermined first elongation rate. The end portion also has a second part having a predetermined elongation rate higher than the first elongation rate. The second part is provided along the predetermined direction between the first part and the central portion. The cleaning sheet is detachably held by the cleaning sheet mounting member at a boundary between the first part and the second part.

The elongation rate according to the invention is a measure of stretchiness of the cleaning sheet, and is preferably defined by an equation of "mm/N" in which "mm" represents milimeter and "N" represents Newton. The higher the elongation rate is, the more stretchy the sheet becomes.

The elongation rates of the first and second parts may be changed, for example, by changing the number of layers of the sheet elements in the first and second parts. Otherwise, the elongation rates of the first and second parts may be changed by changing the entangled state of fibers in the first and second parts. Further, the elongation rates of the first and second parts may be changed by changing the constitution of raw cotton in the first and second parts can be used.

According to the invention, the second part is disposed between the central portion and the first part in the predetermined direction. A boundary is provided between the first part and the second part. The cleaning sheet is detachably held by the cleaning sheet mounting member at a boundary between the first part and the second part. The cleaning sheet may be held by the cleaning sheet mounting member at least at a part of the boundary. By this construction, when a tensile stress during a cleaning operation acts upon the cleaning sheet attached to the cleaning sheet mounting member, the second part at the boundary having a relatively higher elongation rate (more stretchy) elongates and absorbs the tensile stress, while the first part at the boundary having a relatively lower elongation rate (namely being relatively higher rigidity) securely maintains the engagement between the cleaning sheet and the cleaning sheet mounting member. Thus, at a region where the boundary of the cleaning sheet is held by the cleaning sheet mounting member, the second part with relatively high rate of elongation prevents the cleaning sheet from being unwillingly detached from the cleanings sheet mounting member during the cleaning operation and at the same time, the first part with relatively low rate of elongation prevents the cleaning sheet from being broken due to the tensile stress during the cleaning operation.

As another aspect of the invention, the elongation rates of the first and second parts are changed according to the number of layers of the sheet elements in the first and second parts. The second part may preferably be formed by a single sheet element or by a plurality of sheet elements stacked in layer and bonded to each other. The first part may preferably be formed by sheet elements stacked in layer and bonded to each other. The number of sheet elements in layer of the first part may be set lager in number than the number of sheet element(s) of the second part such that the second elongation rate is higher than the first elongation rate. Sheet elements in layer may be provided by stacking different sheet elements separately prepared to each other. Otherwise, sheet elements may be provided by folding one sheet element. The stacked sheet elements may preferably be bonded together. With such a construction, predetermined elongation rate can be easily secured. Further, because the first part and the second part is visibly differentiated due to the different number of sheet elements is layer, boundary between the first and second parts can be easily identified by the user for holding by the cleaning sheet holding member.

Further, as another aspect of the invention, the stacked sheet elements in the first part are bonded together by embossing. Preferably, the sheet elements containing thermoplastic fibers are stacked in layer and bonded together by hot embossing.

Further, as another aspect of the invention, the end portion may preferably have a third part having a lower elongation rate than the second part. The third part may be disposed between the central portion side and the second part in the predetermined direction. The third part may have the same elongation rate as the first part. Otherwise, the third part may have a different elongation rate from the first part.

According to this aspect, the strength of the central portion side can be enhanced, while the cleaning sheet can be prevented from becoming detached from the cleaning sheet mounting member.

Further, as another aspect of the invention, cleaning tool may be provided to have the cleaning sheet and a cleaning sheet mounting member as described above.

Further, the holding member may preferably have a plurality of elastic holding pieces oppositely provided to each other and the boundary of the cleaning sheet may be held by the holding member such that the boundary is pushed to penetrate the holding member through holding pieces and cramped by holding pieces.

According to the claimed invention, usability of cleaning sheets and the cleaning tools are enhanced. Other objects, features and advantages of the present invention will be readily understood after reading the following detailed description together with the accompanying drawings and the claims. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved cleaning sheets and cleaning elements and method for using such cleaning sheets and cleaning elements and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
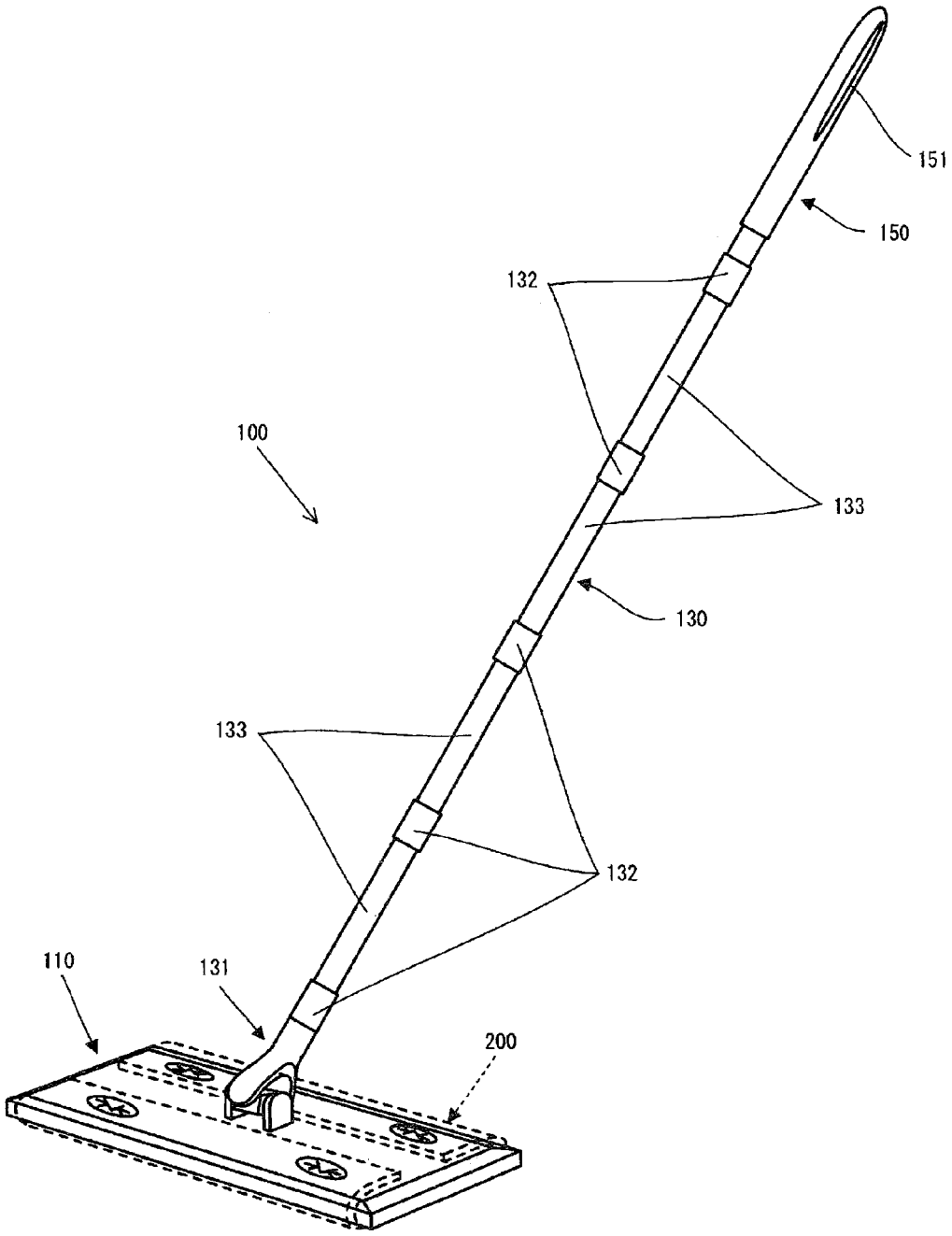
FIG. 1 is a perspective view showing a representative embodiment of a cleaning tool according to the invention.

FIG. 1 is a perspective view showing an embodiment of a cleaning tool 100 according to this invention. The cleaning tool 100 of this embodiment has a head 110 to which a cleaning sheet 200 is attached, a pipe 130 and a handle 150. The pipe 130 is formed by coupling a plurality of pipe elements 133 by coupling mechanisms. Each of the coupling mechanisms includes, for example, a male coupling member provided on one end of one pipe element and a female coupling member provided on the other end of the other pipe element. The connection between the male coupling member and the female coupling member is covered with a cover 132. The one end of the pipe 130 is connected to the handle 150. The other end of the pipe 130 is connected to a connecting mechanism 131 provided on the head 110. In this embodiment, the head 110, the handle 150 and the pipe 130 are features that correspond to the "cleaning sheet mounting member", the "holding member" and the "connecting member for connecting the head and the handle", respectively, according to this invention. The number of the pipe elements 133 forming the pipe 130 can be appropriately selected. Further, the handle 150 may also be directly connected to the connecting mechanism 131 provided on the head 110.

Figure 2:
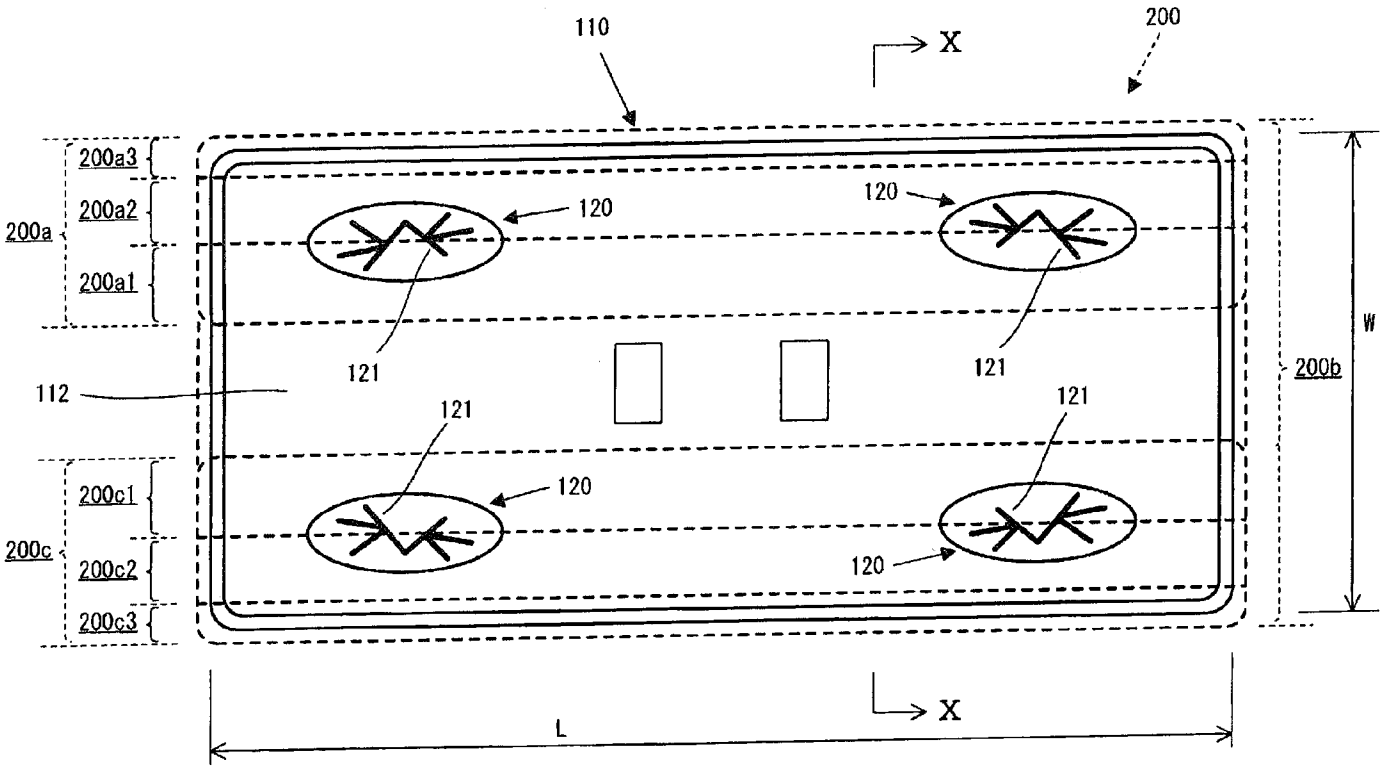
FIG. 2 is a plan view of a head.

The head 110 is shaped like a plate as shown in FIG. 2 and has an upper side 112 on which the connecting mechanism 131 is mounted, and a lower side (mounting side or cleaning side) 111 (see FIG. 10) opposite from the upper side 112. Holding members 120 are provided on the upper side 112. As shown in FIG. 2, each of the holding members 120 has a plurality of elastic holding pieces 121 which are defined by cuts.

Figure 5:
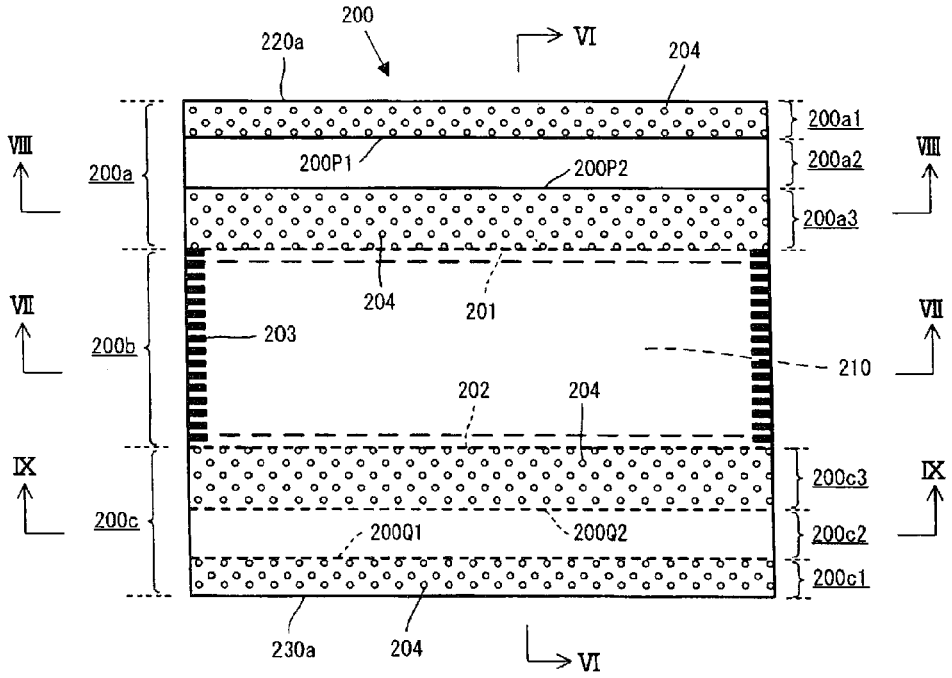
FIG. 5 shows the cleaning sheet 200 of the first embodiment in the unfolded state.
Figure 6:
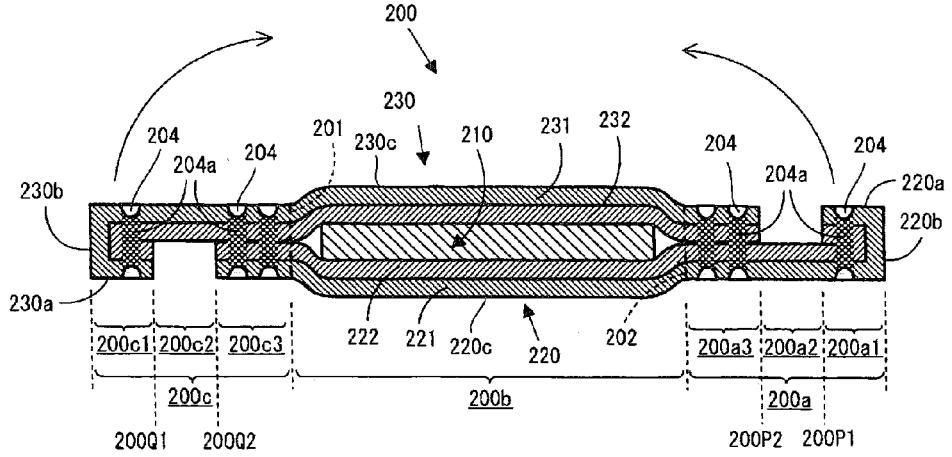
FIG. 6 is a sectional view taken along line VI-VI in FIG. 5.

As shown in FIGS. 5 and 6, the cleaning sheet 200 has a central portion 200*b* and end portions 200*a*, 200*c* provided on both sides of the central portion 200*b*, which will be described below in detail. The central portion 200*b* provides a cleaning face as a main cleaning area of the cleaning sheet 200 during a cleaning operation. The end portion 200*c* defines a mounting portion to the cleaning sheet mounting member (head 110).

The central portion 200*b* of the cleaning sheet 200 is placed to face the lower side (mounting side or cleaning side) 111 of the head 110, and the end portions 200*a*, 200*c* are placed on the upper side 112. Specifically, the cleaning sheet 200 is attached to the head 110 such that the head 110 is covered with the central portion 200*b* and the end portions 200*a*, 200*c*. In the state in which the end portions 200*a*, 200*c* of the cleaning sheet 200 are placed on the upper side 112, points of the end portions 200*a*, 200*c* which are located right above the holding members 120 (holding pieces 121) are pressed down by user's fingers. Thus, the end portions 200*a*, 200*c* of the cleaning sheet 200 are held partly caught between the adjacent holding pieces 121 provided to oppose to each other.

In a cleaning operation using the cleaning tool 100 of this embodiment, generally, the head 110 is moved in a direction transverse to the direction (along a boundary (e.g. folding lines 201, 202 which are described below) between the central portion 200*b* and the end portion 200*a* or 200*c*. The head 110 can also be moved in the other directions.

An embodiment of a cleaning sheet 200 for use with the cleaning tool 100 of this embodiment is now explained.

Figure 4:
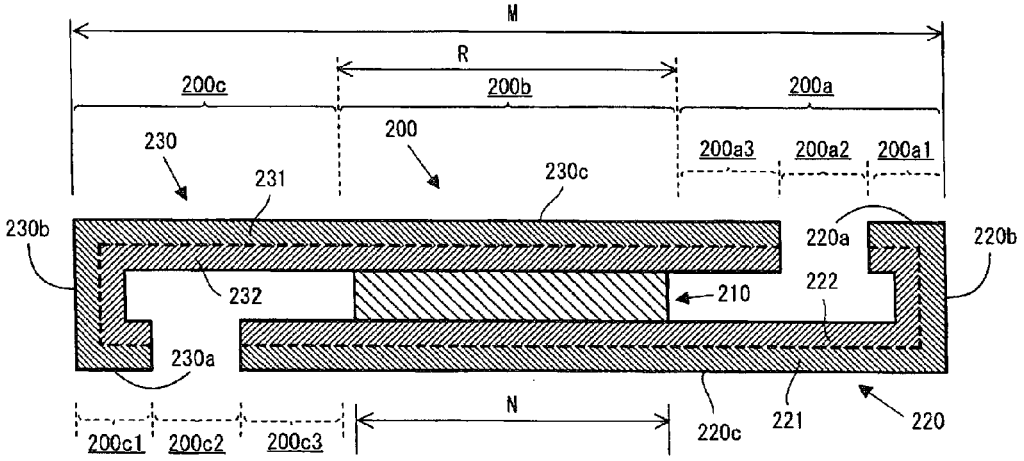
FIG. 4 is a sectional view taken along line IV-IV in FIG. 3.

As shown in FIG. 4, the cleaning sheet 200 has a three-layer structure having a single inner layer sheet 210 and single outer layer sheets 220, 230 disposed on the both sides of the inner layer sheet 210. The "cleaning sheet having a three-layer structure" here includes not only a cleaning sheet having a three-layer structure across the entire region, but a cleaning sheet having a three-layer structure in its main region (e.g. the central portion 200*b*) and not having a three-layer structure (e.g. having a single or two-layer structure) in the other regions. This is also true for multi-layer structures other than the three-layer structure.

A hydrophilic nonwoven fabric sheet is used as the inner layer sheet 210. It is essential for the hydrophilic nonwoven fabric sheet to be hydrophilic as a whole, and the nonwoven fabric sheet may be formed of hydrophilic fibers and hydrophobic fibers. The hydrophilic fibers include rayon fibers, cotton fibers and pulp fibers. In this embodiment, the nonwoven fabric sheet is formed only of rayon fiber having high water absorbency and high moisture retentivity. The inner layer sheet 210 is a feature that corresponds to the "impregnated element", the "third nonwoven fabric sheet" or the "third sheet" according to this invention.

A nonwoven fabric sheet (spun lace nonwoven fabric sheet) manufactured by a water jet method (hydroentangling method) is used as the inner layer sheet 210. In the water jet method, spun lace nonwoven fabric of interlaced fibers is manufactured by jetting high-pressure water, for example, onto a web of randomly arranged fibers from a plurality of nozzles disposed in an orientation transverse to the feeding direction of the web. In this embodiment, each of the nozzles for jetting high-pressure water has orifices having a diameter of 92 μm and continuously arranged over the width of 2.0 mm and such nozzles are arranged at intervals (orifice pitches) of 3.0 mm. By using such nozzles, air-through portions are formed in the spun lace nonwoven fabric, and a striped pattern appears on a finished spun lace nonwoven fabric. Thus, the specific volume ratio of the inner layer sheet 210 increases, so that the amount of impregnation (the amount of water retention) of the inner layer sheet 210 increases. The striped pattern is a feature that corresponds to the pattern of the "patterned indented surface of the inner layer sheet" according to this invention. The orifice pitch (interval of indentations) is set within the range of 2.0 to 10.0 mm, or more suitably, within the range of 2.0 to 3.0 mm. If the orifice pitch exceeds 10.0 mm, fibers are more loosely entangled with each other, so that fluff loss of fibers increases. Further, the strength decreases, so that it becomes difficult to form the nonwoven fabric sheet only of hydrophilic fibers. The inner layer sheet 210 may also be manufactured by other methods, such as through-air bonding, spunbonding, thermal bonding, point bonding, melt blowing, chemical bonding and air-laid methods.

The basis weight of the inner layer sheet 210 is preferably set within the range of 40 to 70 gsm (grams per square meter) from the viewpoint of the amount of release of the cleaning solution, but it may exceed 70 gsm.

A hydrophobic nonwoven fabric sheet is used as the outer layer sheets 220, 230. It is essential for the hydrophobic nonwoven fabric sheet to be predominately hydrophobic, and the nonwoven fabric sheet may be formed of hydrophilic fibers and hydrophobic fibers. The hydrophobic fibers include polyethylene terephthalate (PET) fibers, polypropylene (PP) fibers, polyethylene (PE) fibers and nylon fibers. One of the outer layer sheets 220, 230 and the other are features that correspond to the "first nonwoven fabric sheet" or the "first sheet" and the "second nonwoven fabric sheet" or the "second sheet", respectively, according to this invention.

Further, in this embodiment, a spun lace nonwoven fabric sheet manufactured by a water jet method (hydroentangling method) is used as the outer layer sheets 220, 230. Nonwoven fabric sheets manufactured by various other methods may also be used as the outer layer sheets 220, 230.

In the cleaning sheet 200 of this embodiment, as shown in FIG. 4, the outer layer sheet 220 (230) has a two-layer structure having a layer (inner layer) 222 (232) facing the inner layer sheet 210, and a layer (outer layer) 221 (231) on the opposite side from the side facing the inner layer sheet 210.

In this embodiment, the outer layer sheets 220, 230 are formed of fibers mainly consisting of thermoplastic fibers. Thermoplastic fibers forming the inner layers 222, 232 have a lower melting point than thermoplastic fibers forming the outer layers 221, 231.

The outer layer sheets 220, 230 consist, for example, of polyethylene terephthalate (PET) fibers which are thermoplastic fibers, in major proportions and of rayon fibers. For example, the compounding ratio of polyethylene terephthalate (PET) fibers and rayon fibers is 80% by weight: 20% by weight. Further, the polyethylene terephthalate (PET) fibers consist of those having a fineness of 1.1 dtex and those having a fineness of 3.3 at the ratio of 30% by weight:50% by weight.

As the thermoplastic fibers forming the inner layers 222, 232, polyethylene (PE) fibers/polyethylene terephthalate (PET) fibers (core-in-sheath structure) are used. For example, the compounding ratio of polyethylene (PE) fibers/polyethylene terephthalate (PET) fibers and rayon fibers is 70% by weight: 30% by weight.

The basis weight of the outer layer sheets 220, 230 is preferably set within the range of 35 to 40 gsm from the viewpoints of the functionality, productivity, costs, etc., though, if it exceeds 30 gsm, there is no particular problem from the viewpoints of the amount of release of the cleaning solution.

By thus forming the inner layers 222, 232 of the outer layer sheets 220, 230 by using thermoplastic fibers having a lower melting point than thermoplastic fibers of the outer layers 221, 231, even if the inner layer sheet 210 contains no thermoplastic fibers, the inner layer sheet 210 and the outer layer sheets 220, 230 can be bonded together by the thermoplastic fibers having a lower melting point which are contained in the inner layer 222 of the outer layer sheet 220 and the inner layer 232 of the outer layer sheet 230.

When the outer layer sheet 220 (230) having the inner layer 222 (232) and the outer layer 221 (231) is heated at a temperature which is higher than the melting point of the thermoplastic fibers of the inner layer 222 (232) and lower than the melting point of the thermoplastic fibers of the outer layer 221 (231), a fusion bonded layer is formed in the inner layer 222 (232). As a result, most of the fibers in the inner layer 222 (232) of the outer layer sheet 220 (230) are joined together by fusion bonding, so that the amount of the cleaning solution which is released from the inner layer sheet 210 to the outer layer sheet 220 (230) is controlled.

As described above, in the prior art, each of the ends of the sheet has substantially the same elongation rate across its entire region, while low-hydroentangled part is provided with the central portion. Therefore, during cleaning operation which is performed with the ends of the cleaning sheet held by the holding members of the head of the cleaning tool, the cleaning sheet easily becomes detached from the holding members.

Therefore, in this invention, each of the ends of the cleaning sheet has a first part having a first elongation rate and a second part having an elongation rate higher than the first elongation rate. The second part is disposed on the central portion side of the first part, and a boundary between the first and second parts is formed at the point which is held by the holding members 120 of the head 110 of the cleaning tool.

Figure 3:
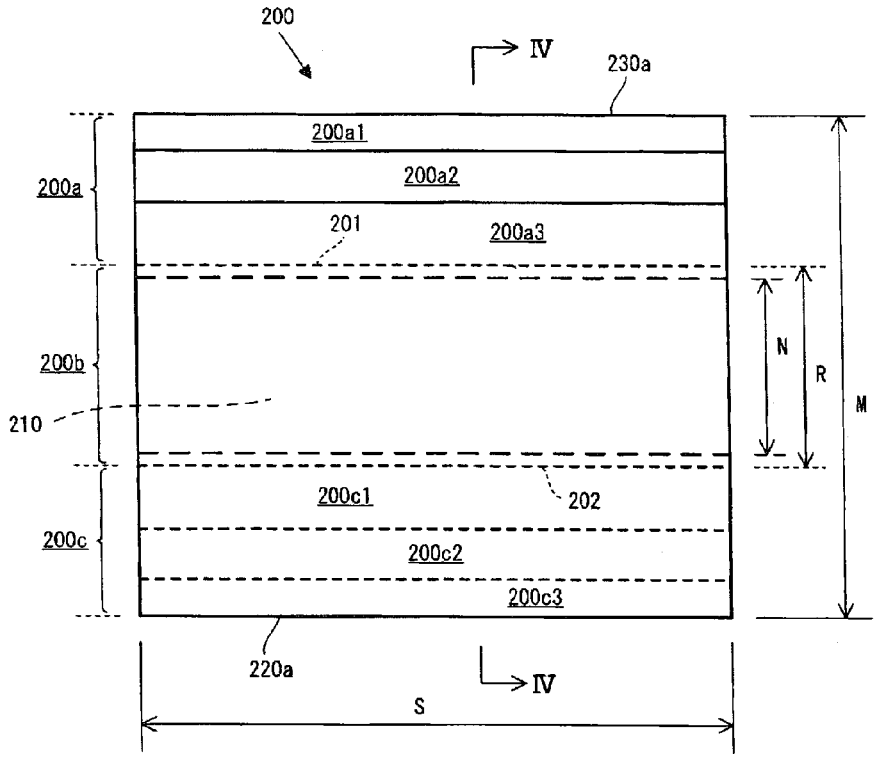
FIG. 3 shows a schematic structure of a cleaning sheet 200 according to one embodiment.

The inner layer sheet 210 and the outer layer sheets 220, 230 are arranged as shown in FIGS. 3 and 4. FIG. 4 is a sectional view taken along line IV-IV in FIG. 3.

As shown in FIG. 3, the cleaning sheet 200 has a rectangular shape having a width M (e.g. 205 mm) and a length S (e.g. 275 mm). The inner layer sheet 210 has a rectangular shape having a width N (e.g. 90 mm) and the length S. The outer layer sheets 220, 230 have a rectangular shape having a width (e.g. 190 mm) shorter than the width M and the length S.

The outer layer sheet 220 (230) includes a base 220*c* (230*c*). One end of the outer layer sheet 220 (230) in the width direction is folded over to the inner layer 222 (232) side along a folding line 220*b* (230*b*) at a predetermined distance from the one end, so that a folded part 220*a* (230*a*) is formed. The folded part 220*a* is stacked with a part of the base 220*c* (230*c*). As shown in FIG. 4, the outer layer sheets 220, 230 having the respective folded parts 220*a*, 230*a* are arranged on the both sides of the inner layer sheet 210 so as to oppose to each other. At this time, inner layer 222 of the outer layer sheet 220 and inner layer 232 of the outer layer sheet 230 are located to the inner sheet 210 so as to oppose to each other. The inner layer sheet 210 is centrally located in the direction of the width M. The folded parts 220*a*, 230*a* of the outer layer sheets 220, 230 are arranged on the opposite sides of the inner layer sheet 210 in the width direction. Further, the folding lines 201, 202 are provided in the cleaning sheet 200 toward the center in the width direction and spaced a distance R apart from each other which is equal to or longer than the width N of the inner layer sheet 210 (R≥N).

Thus, as shown in FIG. 3, the cleaning sheet 200 is divided into the centrally located central portion 200*b* and the end portions 200*a*, 200*c* provided on the both sides of the central portion 200*b* in the width direction by the folding lines 201, 202. The end portion 200*a* (200*c*) has a first part 200*a*1 (200*c*1) of a two-layer structure having the folded part 220*a* (230*a*) and a base 220*c* (230*c*) of the outer layer sheet 220 (230) stacked in layer, a second part 200*a*2 (200*c*2) of a single-layer structure having the base 220*c* (230*c*) of the outer layer sheet 220 (230), and a third part 200*a*3 (200*c*3) of a two-layer structure having the base 220*c* of the outer layer sheet 220 and a base 230*c* of the outer layer sheet 230 stacked in layer. The central portion 200*b* has a three-layer structure having the base 220*c* of the outer layer sheet 220, the base 230*c* of the outer layer sheet 230 and the inner layer sheet 210 stacked in layer.

The folding lines 201, 202 serve as guides for positioning the central portion 200*b* of the cleaning sheet 200 such that it faces the lower side (cleaning side) 111 of the head 110 when the cleaning sheet 200 is attached to the head 110 of the cleaning tool 100. A width R of the central portion 200*b* of the cleaning sheet 200 (distance between the folding lines 201, 202) is preferably equal to or longer than a width W of the lower side (mounting side) 111 of the head 110 of the cleaning tool 100 (R≥W). Further, the width N of the inner layer sheet 210 is preferably equal to or shorter than the width W of the lower side (mounting side) 111 of the head 110 of the cleaning tool 100 (N≤W). The relationship between the distance R, the width N and the width W is not limited to this.

In this embodiment, a direction (the horizontal direction as viewed in FIG. 3) along the folding lines 201, 202, 220*a*, 230*a* is referred to as the "length direction", and a direction transverse (perpendicular) to the folding lines 201, 202, 220*a*, 230*b* is referred to as the "width direction". In the case of the cleaning sheet 200 having no folding lines 201, 202, 220*b*, 230*b*, the predetermined direction of the cleaning sheet 200 in which end portions 200*a* and 200*c* extend is referred to as the "length direction", and a direction transverse (perpendicular) to the predetermined direction is referred to as the "width direction". The "width direction" in this embodiment corresponds to the "the predetermined direction" according to this invention.

The inner layer sheet 210 and the outer layer sheets 220, 230 are bonded together as shown in FIGS. 5 and 6 in order to fix the inner layer sheet 210 to the outer layer sheets 220, 230 in the state in which the inner layer sheet 210 and the outer layer sheets 220, 230 are arranged as shown in FIGS. 3 and 4. FIG. 6 is a sectional view taken along line VI-VI in FIG. 5.

When the inner layer sheet 210 is bonded to the outer layer sheets 220, 230, the cleaning solution impregnated in the inner layer sheet 210 is released from the inner layer sheet 210 to the outer layer sheets 220, 230 via bonded portions between the inner layer sheet 210 and the outer layer sheets 220, 230. Therefore, a bonding area of bonding the inner layer sheet 210 and the outer layer sheets 220, 230 is preferably located away from the center of an area (main cleaning area) of the cleaning sheet which is used for normal cleaning operation. In other words, the bonding area is preferably located at a position in which the cleaning operation is less affected by the cleaning solution via the bonded portions. In this embodiment, the central portion 200*b* in which the inner layer sheet 210 is disposed is located to face the lower side (mounting side) 111 of the head 110 of the cleaning tool 100, and therefore, cleaning is performed with the central portion 200*b*. Thus, the central portion 200*b* of the cleaning sheet 200 forms a "main cleaning area".

Therefore, in this embodiment, as shown in FIG. 5, the inner layer sheet 210 is bonded to the outer layer sheets 220, 230 on edges (ends) of the outer layer sheets 220, 230 on the both ends in the length direction (horizontal direction as viewed in FIG. 5). Specifically, the bonding area of bonding the inner layer sheet 210 and the outer layer sheets 220, 230 is located away from the center of an area (main cleaning area) of the cleaning sheet which is used for normal cleaning operation.

Figure 7:
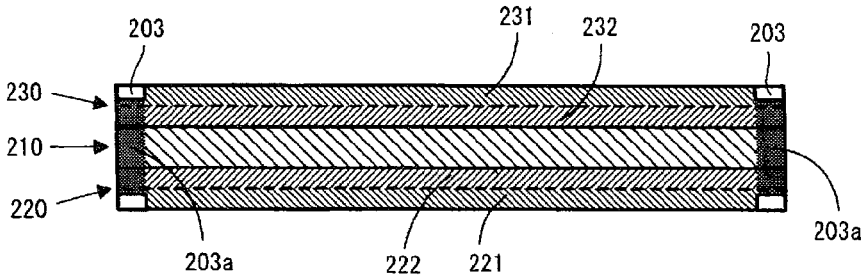
FIG. 7 is a sectional view taken along line VII-VII in FIG. 5.

In this embodiment, a hot embossing method is used for the bonding. In FIG. 5, hot embossed portions 203 are formed on the edges of the outer layer sheets 220, 230 on the both ends in the length direction. As shown in FIG. 7, the hot embossed portions 203 and bonded portions 203*a* in which the inner layer sheet 210 is bonded to the outer layer sheets 220, 230 are formed by hot embossing the outer layer sheets 220, 230. In this embodiment, the outer layer sheets 220, 230 are formed of fibers containing thermoplastic fibers. Therefore, the inner layer sheet 210 is bonded to the outer layer sheets 220, 230 via the thermoplastic fibers forming the outer layer sheets 220, 230 (particularly, the thermoplastic fibers which have a lower melting point and are contained in the inner layer 222 of the outer layer sheet 220 and the inner layer 232 of the outer layer sheet 230) by hot embossing the outer layer sheets 220, 230.

In this specification, hot embossing for bonding the inner layer sheet 210 and the outer layer sheets 220, 230 is referred to as the "first hot embossing".

In this embodiment, it is necessary to prevent the cleaning solution impregnated in the inner layer sheet 210 from leaking out from its ends in the width direction.

Figure 8:
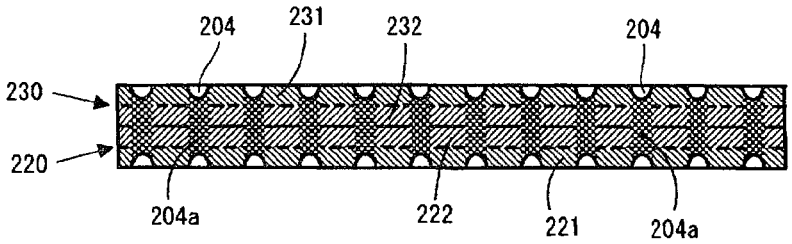
FIG. 8 is a sectional view taken along line VIII-VIII in FIG. 5.
Figure 9:
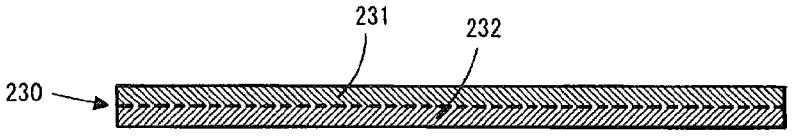
FIG. 9 is a sectional view taken along line IX-IX in FIG. 5.

In this embodiment, as shown in FIG. 6, in the third parts 200*a*3, 200*c*3 located on the both sides of the inner layer sheet 210 in the width direction, the outer layer sheets 220, 230 are bonded together. Various bonding methods can be used for bonding the outer layer sheets 220, 230. In this embodiment, the outer layer sheets are bonded together by hot embossing using a roller having depressions and projections. As shown in FIG. 8, hot embossed portions 204 and bonded portions 204*a* in which the inner layer sheet 210 is bonded to the outer layer sheets 220, 230 are formed by hot embossing the outer layer sheets 220, 230.

In this embodiment, thermoplastic fibers having a lower melting point are disposed in the outer layer sheets 220, 230. Further, the inner layer sheet 210 is not disposed in the third parts 200*a*3, 200*c*3. Therefore, in the third parts 200*a*3, 200*c*3, the outer layer sheets 220, 230 can be easily bonded together by hot embossing.

The strength of the outer layer sheets 220, 230 is increased by bonding the outer layer sheets 220, 230 by hot embossing.

In this embodiment, hot embossing for bonding the outer layer sheets 220, 230 is referred to as the "second hot embossing".

In this embodiment, only the edges of the inner layer sheet 210 on the both ends in the length direction are subjected to first hot embossing, but the edges of the third parts 200*a*3, 200*c*3 on the both ends in the length direction may also be subjected to first hot embossing.

In this embodiment, in order that the first part 200*a*1 (200*c*1) has a lower elongation rate than the second part 200*a*2 (200*c*2), the folded part 220*a* and the base 220*c* of the outer layer sheet 220 (the folded part 230*a* and the base 230*c* of the outer layer sheet 230) are bonded together in the first part 200*a*1 (200*c*1). Various bonding methods can be used for bonding the folded part 220*a* and the base 220*c* of the outer layer sheet 220 (the folded part 230*a* and the base 230*c* of the outer layer sheet 230). In this embodiment, they are bonded together by hot embossing using a roller having depressions and projections.

In this embodiment, thermoplastic fibers having a lower melting point are contained in the outer layer sheet 220 (230). Further, the inner layer sheet 210 is not disposed between the folded part 220*a* and the base 220*c* of the outer layer sheet 220 (the folded part 230*a* and the base 230*c* of the outer layer sheet 230). Therefore, in the first part 200*a*1 (200*c*1), the folded part 220*a* and the base 220*c* of the outer layer sheet 220 (the folded part 230*a* and the base 230*c* of the outer layer sheet 230) can be easily bonded together by hot embossing.

By this hot embossing, the first part 200*a*1 formed by the folded part 220*a* and the base 220*c* of the outer layer sheet 220 and the first part 200*c*1 formed by the folded part 230*a* and the base 230*c* of the outer layer sheet 230 have a lower elongation rate than the second parts 200*a*2, 200*c*2. Specifically, the first parts 200*a*1, 200*c*1 are harder to stretch than the second parts 200*a*2.

The elongation rate (mm/N) of the sheet is a measure of stretchiness. The higher the elongation rate, the more stretchy the sheet.

In this specification, hot embossing for bonding the outer layer sheets 220, 230 in the first parts 200*a*1, 200*c*1 is referred to as the "third hot embossing".

Further, the inner layer sheet 210 is impregnated with cleaning solution. An appropriate cleaning solution by which dirt or contamination of the object to be cleaned can be removed can be used as the cleaning solution. For example, water-based cleaning solution containing alcohol, a surfactant, a solvent, an antiseptic, etc. can be used. Further, a floor protective agent, an abrasive, a freshener, perfume, etc. may be added to the cleaning solution. The amount of cleaning solution to be impregnated into the inner layer sheet 210 can be appropriately determined. For example, cleaning solution of two to five times the weight of the yet-to-be impregnated cleaning sheet 200 (the inner layer sheet 210 and the outer layer sheets 220, 230) is impregnated into the inner layer sheet 210. Various methods can be used for impregnating the cleaning solution into the inner layer sheet 210. For example, the cleaning sheet 200 may be formed by using the inner layer sheet 210 which is impregnated with the cleaning solution in advance. Alternatively, after the cleaning sheet 200 is formed, the cleaning solution may be applied to the central portion 200*b* of the outer layer sheets 220, 230 so that the inner layer sheet 210 is impregnated with the cleaning solution via the outer layer sheets 220, 230.

Figure 10:
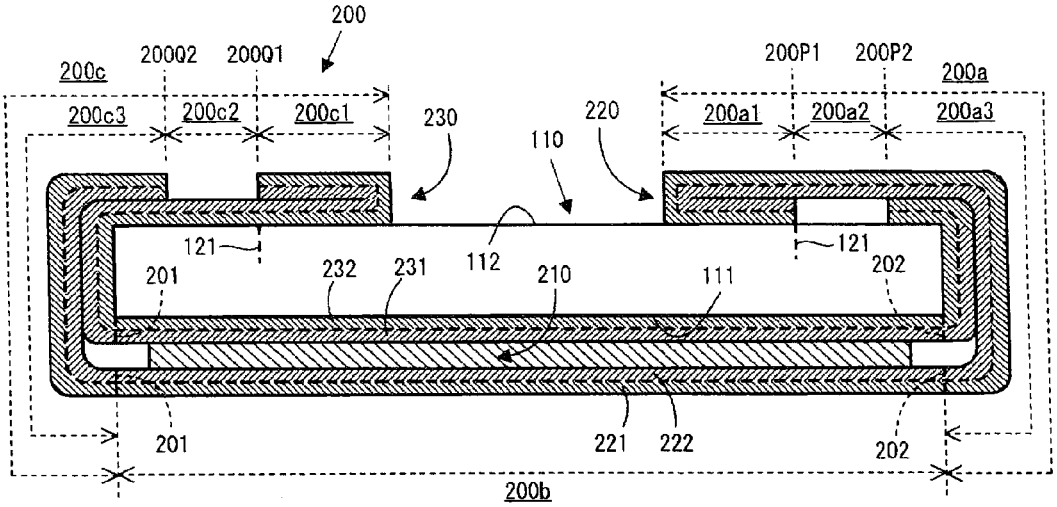
FIG. 10 is a sectional view taken along line X-X in FIG. 2.

FIG. 10 shows the cleaning sheet 200 in this embodiment which is attached to the head 110. FIG. 10 is a sectional view taken along line X-X (in the width direction) in FIG. 2.

As shown in FIG. 10, the central portion 200*b* of the cleaning sheet 200 is located to face the lower side (mounting side) 111 of the head 110. The end portions 200*a*, 200*c* of the cleaning sheet 200 are folded over along the folding lines 201, 202 and placed on the upper side 112 of the head 110. In this embodiment, the length of the first parts 200*a*1, 200*c*1 (the length of the folded parts 220*a*, 230*a*) is set e.g. to 20 mm. Therefore, when the central portion 200*b* of the cleaning sheet 200 is placed to face the lower side (mounting side) 111 of the head 110, and the end portions 200*a*, 200*c* are placed on the upper side 112 of the head 110, part of a boundary 200P1 between the first part 200*a*1 and the second part 200*a*2 and part of a boundary 200Q1 between the first part 200*c*1 and the second part 200*c*2 are placed to face the holding members 120 (holding pieces 121).

Figure 11:
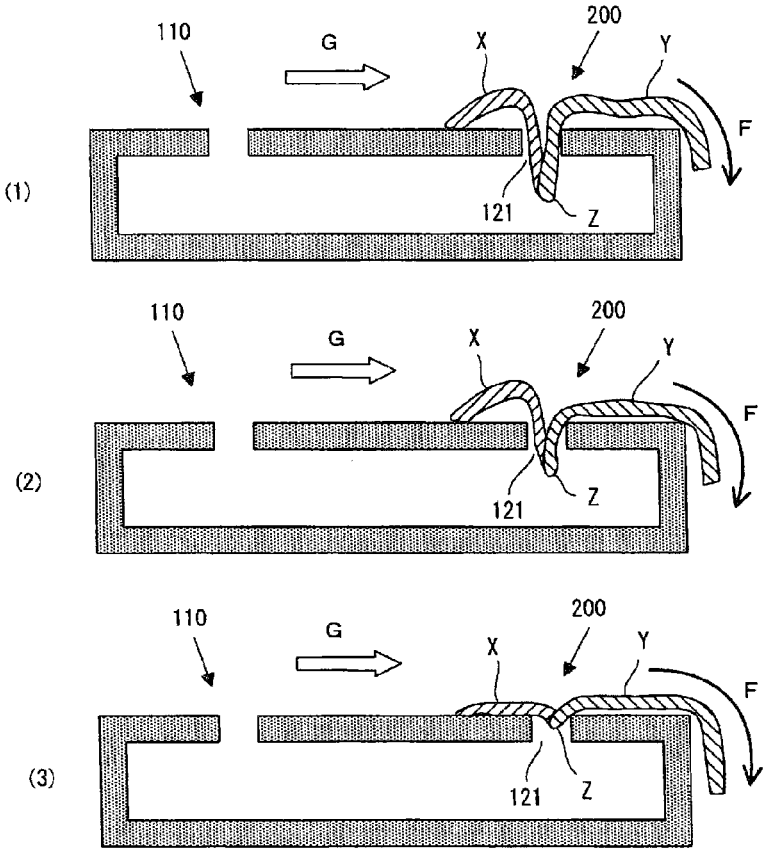
FIG. 11 is a view for illustrating operation of this invention.

In this state, when the portions facing the holding pieces 121 are pushed in between the holding pieces 121 by the fingers and then released, part of the boundary 200P1 between the first part 200*a*1 and the second part 200*a*2 and part of the boundary 200Q1 between the first part 200*c*1 and the second part 200*c*2 are caught and held between the holding pieces 121. As shown in FIG. 11, the intermediate parts of the boundary 200P1 and 200Q1 cramped and held by the holding pieces 121 are pushed to penetrate the holding pieces 121. At this time, as shown in FIG. 10, the first parts 200*a*1, 200*c*1 are located nearer to the center than the second parts 200*a*2, 200*c*2 (on the opposite side from the central portion 200*b*) and held by the holding pieces 121.

According to this embodiment, boundary 200P1 (200Q1) between the first part 200*a*1 with relatively low elongation rate and the second part 200*a*2 with relatively high elongation rate is partly held by the holding pieces 121 opposing to each other. In other words, inflecting region of the elongation rate is held by the holding pieces 121.

Therefore, even if a tensile force acts upon the cleaning sheet 200 in a direction opposite to the direction of movement of the head 110 by a frictional force of the area to be cleaned during cleaning operation which is performed with the ends 200*a*, 200*c* of the cleaning sheet 200 held by the holding pieces 112, such tensile force is buffered by the second part 200*a*2 and/or 200*c*2 with high elongation rate. As a result, the ends 200*a*, 200*c* of the cleaning sheet 200 can be prevented from becoming detached from the holding pieces 121. Further, when user of the cleaning tool tries to detach the cleaning sheet 200 from the head 110, the sheet 200 can be easily detached from the head 110 such that the first part 200*a*1 (200*c*1) is pulled out and the boundary 200P1 (200Q1) is pulled out from the gap between the adjacent holding pieces 121.

Further, according this embodiment, the second part 200*a*2 (200*c*2) with relatively high elongation rate is formed by a single layer, while the first part 200*a*1 (200*c*1) with relatively low elongation rate is formed by two layers by folding and stacking the sheet element. As a result, the cleaning sheet 200 can be manufactured at low cost.

Further, according to this embodiment, the first part 200*a*1 (200*c*1) is provided with 2 layers, while the second part 200*a*2 (200*c*2) is provided with a single layer, the boundary 200P1 (200Q1) can be visibly clearly identified. Thus, usability of the cleaning sheet 200 is enhanced.

Operation of this invention is conceptually explained with reference to FIG. 11. In FIG. 11, for the sake of simplicity of explanation, the end 200*a* (200*c*) of the cleaning sheet 200 has a first member X having a first elongation rate and a second member Y having a second elongation rate higher than the first elongation rate and located between the central portion 200*b* and the first member X. The first member X corresponds to the first part 200*a*1 (200*c*1) and the second member Y corresponds to the second part 200*a*2 (200*c*2), respectively. Further, the head 110 is moved in a direction shown by the hollow arrow G (rightward) in FIG. 11 with a boundary Z between the first member X and the second member Y partly held by the holding members 120 (the holding pieces 121) of the head 110. The boundary Z corresponds to the boundary 200P1 (200Q1).

When the head 110 is moved in the direction of the hollow arrow G, as shown in FIG. 11 (1), a tensile stress acts in the direction of the solid arrow F upon the second member Y of the end which is located in the direction of the hollow arrow G.

In the prior art, each of the ends of the sheet has substantially the same elongation rate across its entire region, so that the member held by the holding members 120 (the holding pieces 121) uniformly stretches. Therefore, the end 200*a* (200*c*) of the cleaning sheet 200 easily becomes detached from the holding members 120 (the holding pieces 121).

On the contrary, according to this embodiment, as shown in FIG. 11 (2), the second member Y having a higher elongation rate tends to stretch and tensile force is absorbed by the second member Y. In this case, the boundary Z between the first member X and the second member Y is held by the holding pieces 121 and kept in this state, so that the end 200*a* (200*c*) of the cleaning sheet 200 is prevented from becoming detached from the holding pieces 121.

When the tensile stress acting upon the end of the cleaning sheet 200 increases, as shown in FIG. 11 (3), the boundary Z between the first member X and the second member Y is pulled and detached from the holding pieces 121. In this case, the end 200*a* (200*c*) of the cleaning sheet 200 becomes detached from the holding pieces 121.

Energy required for removing the cleaning sheet held by the holding pieces is measured in embodiments 1 to 4 and comparative examples 1 to 7 of the cleaning sheets of this invention. FIGS. 12 to 18 show the constructions of the cleaning sheets of embodiments 1 to 4 and comparative examples 1 to 7.

In embodiments 1 to 4 and comparative examples 1 to 7, the width M is 205 mm. Further, if the boundary Z between the first member X and the second member Y is located within the range of 20 to 40 mm from the ends (edges) in the width direction, the boundary Z between the first member X and the second member Y is placed to face the holding pieces of the head when the cleaning sheet is attached to the head.

In the following description, the "MD direction" represents the direction of the machine during manufacturing, and the "CD direction" represents a direction perpendicular to the MD direction.

Embodiment 1

Figure 12:
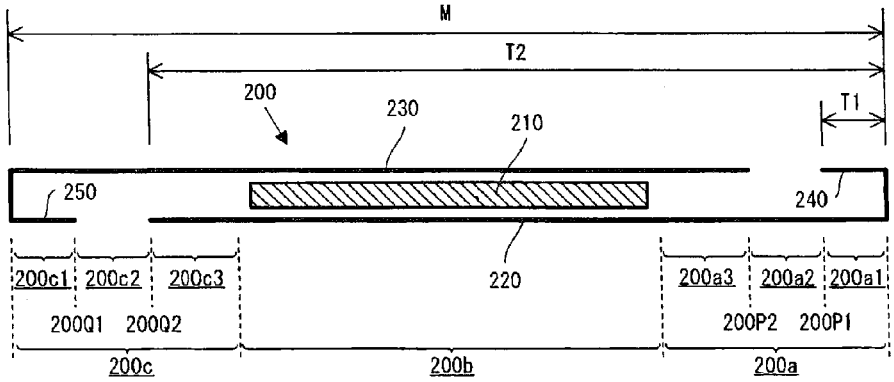
FIG. 12 shows the schematic construction of embodiment 1.

Embodiment 1 has the construction shown in FIG. 12. Each of outer layer sheets 220, 230 has a width of 190 mm and has one end in the width direction which is folded so that folded part 220*a* or 230*a* is formed. The folded parts 220*a*, 230*a* have a length T1 of 20 mm. The outer layer sheets 220, 230 are arranged on both sides of an inner layer sheet 210. In each embodiment, hot embossing is performed on a needed area, which is not particularly specified.

In embodiment 1, a first part 200*a*1 (200*c*1) or the first member X having a lower elongation rate has a two-layer structure having the outer layer sheets 220, 230. A second part 200*a*2 (200*c*2) or the second member Y having a higher elongation rate has a single-layer structure having the outer layer sheet 220 (230). Further, the CD direction of the outer layer sheets 220, 230 coincides with the width direction of the sheet (the horizontal direction in FIG. 12).

According to the embodiment 1, the first member X has the elongation rate of 1.00 mm/N, and the second member Y has the elongation rate of 3.30 mm/N.

Embodiment 2

Figure 13:
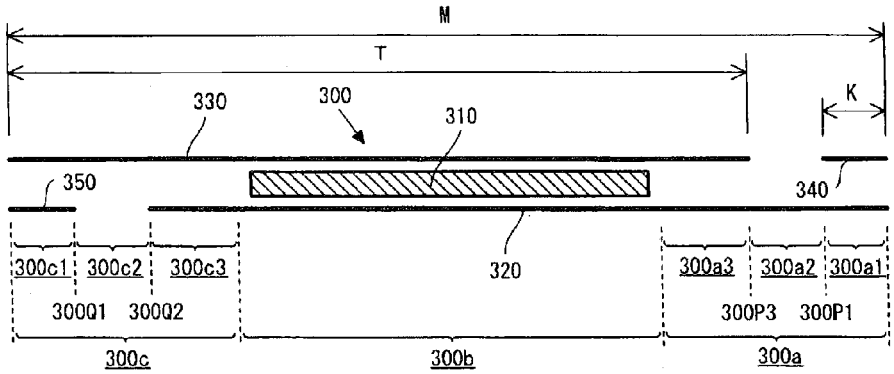
FIG. 13 shows the schematic construction of embodiments 2 and 3.

Embodiment 2 has the construction shown in FIG. 13. Each of outer layer sheets 320, 330 has a width T of 170 mm. The outer layer sheets 320, 330 are arranged on both sides of an inner layer sheet 310, and outer layer sheets 340, 350 having a width K of 20 mm are arranged on the both ends (edges) of the sheet in the width direction.

In embodiment 2, a first part 300*a*1 (300*c*1) or the first member X having a lower elongation rate has a two-layer structure having the outer layer sheets 320 (330), 340 (350). A second part 300*a*2 (300*c*2) or the second member Y having a higher elongation rate has a single-layer structure having the outer layer sheet 320 (330). Further, the CD direction of the outer layer sheets 320, 330 coincides with the width direction of the sheet (the horizontal direction in FIG. 13), and the MD direction of the outer layer sheets 340, 350 coincides with the width direction of the sheet.

According to the embodiment 2, the first member X has the elongation rate of 0.08 mm/N, and the second member Y has the elongation rate of 3.30 mm/N.

Embodiment 3

Embodiment 3 has the construction shown in FIG. 13. Each of the outer layer sheets 320, 330 has a width T of 170 mm.

The outer layer sheets 320, 330 are arranged on the both sides (edges) of the inner layer sheet 310, and 70 g/m$^2$ spunbond nonwoven fabrics (SB) 340, 350 having a width K of 20 mm are arranged on the both ends (edges) of the sheet in the width direction.

In embodiment 3, the first part 300*a*1 (300*c*1) or the first member X having a lower elongation rate has a two-layer structure having the outer layer sheet 320 (330) and the 70 g/m$^2$ spunbond nonwoven fabric 340 (350). A second part 300*a*2 (300*c*2) or the second member Y having a higher elongation rate has a single-layer structure having the outer layer sheet 320 (330). Further, the CD direction of the outer layer sheets 320, 330 coincides with the width direction of the sheet (the horizontal direction in FIG. 13).

According to the embodiment 3, the first member X has the elongation rate of 0.06 mm/N, and the second member Y has the elongation rate of 3.30 mm/N.

Embodiment 4

Figure 14:
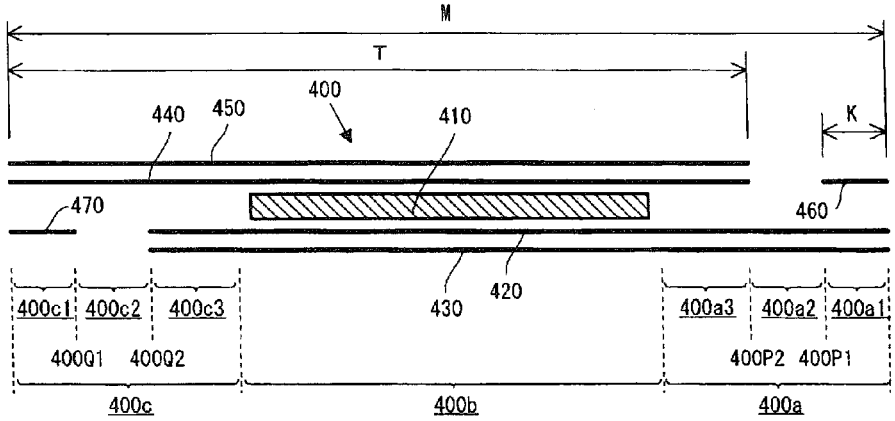
FIG. 14 shows the schematic construction of embodiment 4.

Embodiment 4 has the construction shown in FIG. 14. Each of outer layer sheets 420, 430, 440, 450 has a width T of 170 mm. The outer layer sheets 420, 430 and 440, 450 are arranged on the both sides of the inner layer sheet 310, and 70 g/m$^2$ spunbond nonwoven fabrics 340, 350 having a width K of 20 mm are arranged on the both ends (edges) of the sheet in the width direction.

In embodiment 4, a first part 400*a*1 (400*c*1) or the first member X having a lower elongation rate has a three-layer structure having the outer layer sheet 420, 430 (440, 450) and the 70 g/m$^2$ spunbond nonwoven fabric 460 (470). A second part 400*a*2 (400*c*2) or the second member Y having a higher elongation rate has a two-layer structure having the outer layer sheets 420, 430 (440, 450). Further, the CD direction of the outer layer sheets 420, 430, 440, 450 coincides with the width direction of the sheet (the horizontal direction in FIG. 14).

According to the embodiment 4, the first member X has the elongation rate of 0.06 mm/N, and the second member Y has the elongation rate of 1.00 mm/N.

Comparative Example 1

Figure 15:
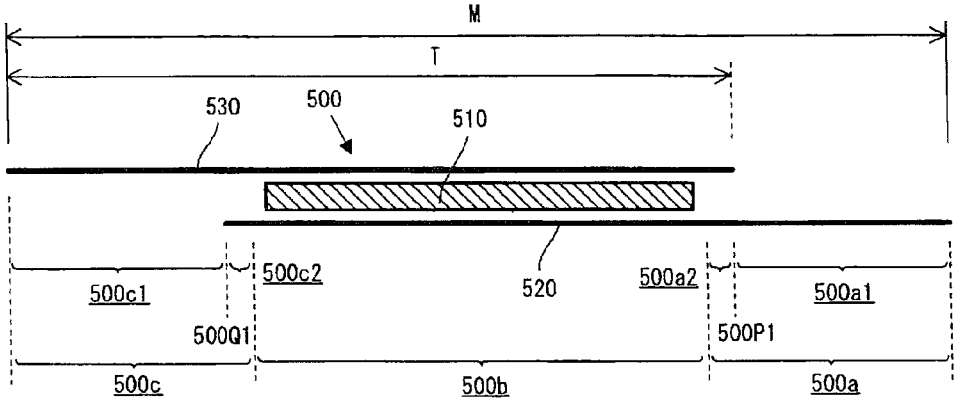
FIG. 15 shows the schematic construction of comparative example 1.

Comparative example 1 has the construction shown in FIG. 15. Each of outer layer sheets 520, 530 has a width of 150 mm. The outer layer sheets 520, 530 are arranged on both sides of an inner layer sheet 510.

In comparative example 1, a first part 500*a*1 (500*c*1) having a width of 55 mm from the end of the sheet in the width direction has a single-layer structure having the outer layer sheet 520 (530). Further, the CD direction of the outer layer sheets 520, 530 coincides with the width direction of the sheet (the horizontal direction in FIG. 15).

According to the comparative example 1, the first member X has the elongation rate of 3.30 mm/N, and the second member Y has the elongation rate of 3.30 mm/N.

Comparative Example 2

Figure 16:
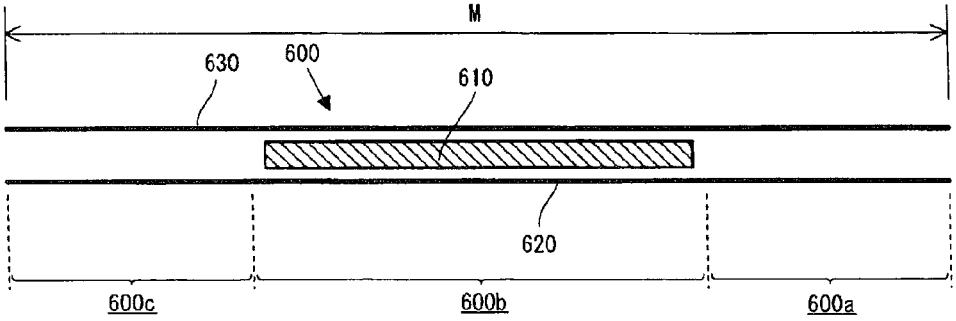
FIG. 16 shows the schematic construction of comparative examples 2 and 3.

Comparative example 2 has the construction shown in FIG. 16. Each of outer layer sheets 620, 630 has a width of 205 mm. The outer layer sheets 620, 630 are arranged on both sides of an inner layer sheet 610.

In comparative example 2, a first part 600*a* (600*c*) having a width of 55 mm from the end of the sheet in the width direction has a two-layer structure having the outer layer sheets 620, 630. Further, the CD direction of the outer layer sheets 620, 630 coincides with the width direction of the sheet (the horizontal direction in FIG. 16).

According to the comparative example 2, the first member X has the elongation rate of 1.00 mm/N, and the second member Y has the elongation rate of 1.00 mm/N.

Comparative Example 3

Comparative example 3 has the construction shown in FIG. 16. Each of outer layer sheets 620, 630 has a width of 205 mm. The outer layer sheets 620, 630 are arranged on both sides of an inner layer sheet 610.

In comparative example 3, a first part 600*a* (600*c*) having a width of 55 mm from the end of the sheet in the width direction has a two-layer structure having the outer layer sheets 620, 630. Further, the CD direction of the outer layer sheet 620 and the MD direction of the outer layer sheet 630 coincide with the width direction of the sheet (the horizontal direction in FIG. 16).

According to the comparative example 3, the first member X has the elongation rate of 0.08 mm/N, and the second member Y has the elongation rate of 0.08 mm/N.

Comparative Example 4

Figure 17:
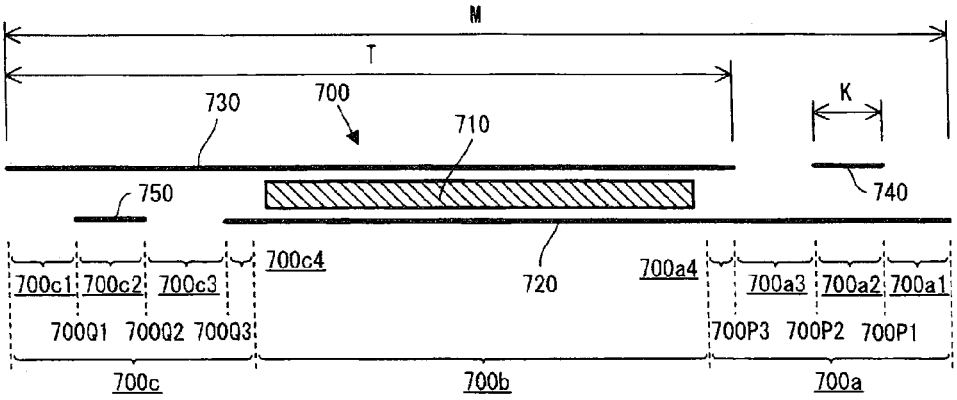
FIG. 17 shows the schematic construction of comparative examples 4 to 6.

Comparative example 4 has the construction shown in FIG. 17. Each of outer layer sheets 720, 730 has a width T of 150 mm. The outer layer sheets 720, 730 are arranged on both sides of an inner layer sheet 710. Further, outer layer sheets 740, 750 having a width K of 20 mm are arranged 20 to 40 mm away from the end of the sheet in the width direction.

In comparative example 4, a first part 700*a*1 (700*c*1) having a width of 20 mm from the end of the sheet in the width direction has a single-layer structure having the outer layer sheet 720 (730). A second part 700*a*2 (700*c*2) extending in the range of 20 to 40 mm from the end of the sheet in the width direction has a two-layer structure having the outer layer sheet 720, 740 (730, 750). Further, the CD direction of the outer layer sheets 720, 730, 740, 750 coincides with the width direction of the sheet (the horizontal direction in FIG. 17).

According to the comparative example 4, the first member X has the elongation rate of 3.30 mm/N, and the second member Y has the elongation rate of 1.00 mm/N.

Comparative Example 5

Comparative example 5 has the construction shown in FIG. 17. Each of outer layer sheets 720, 730 has a width T of 150 mm. The outer layer sheets 720, 730 are arranged on both sides of an inner layer sheet 710. Further, outer layer sheets 740, 750 having a width K of 20 mm are arranged 20 to 40 mm away from the end of the sheet in the width direction.

In comparative example 5, a first part 700*a*1 (700*c*1) having a width of 20 mm from the end of the sheet in the width direction has a single-layer structure having the outer layer sheet 720 (730). A second part 700*a*2 (700*c*2) extending in the range of 20 to 40 mm from the end of the sheet in the width direction has a two-layer structure having the outer layer sheet 720, 740 (730, 750). Further, the CD direction of the outer layer sheets 720, 730 and the MD direction of the outer layer sheets 740, 750 coincide with the width direction of the sheet (the horizontal direction in FIG. 17).

According to the comparative example 5, the first member X has the elongation rate of 3.30 mm/N, and the second member Y has the elongation rate of 0.08 mm/N.

Comparative Example 6

Comparative example 6 has the construction shown in FIG. 17. Each of outer layer sheets 720, 730 has a width T of 150 mm. The outer layer sheets 720, 730 are arranged on both sides of an inner layer sheet 710. Further, 70 g/m$^2$ spunbond nonwoven fabrics 740, 750 having a width K of 20 mm are arranged 20 to 40 mm away from the end of the sheet in the width direction.

In comparative example 6, a first part 700*a*1 (700*c*1) having a width of 20 mm from the end of the sheet in the width direction has a single-layer structure having the outer layer sheet 720 (730). A second part 700*a*2 (700*c*2) extending in the range of 20 to 40 mm from the end of the sheet in the width direction has a two-layer structure having the outer layer sheet 720 (730) and the 70 g/m$^2$ spunbond nonwoven fabric 740 (750). Further, the CD direction of the outer layer sheets 720, 730 coincide with the width direction of the sheet (the horizontal direction in FIG. 17).

According to the comparative example 6, the first member X has the elongation rate of 3.30 mm/N, and the second member Y has the elongation rate of 0.06 mm/N.

Comparative Example 7

Figure 18:
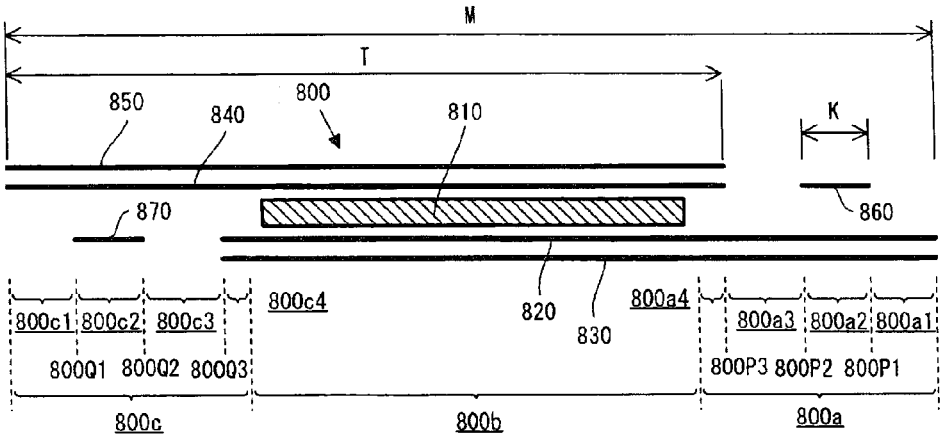
FIG. 18 shows the schematic construction of comparative example 7.

Comparative example 7 has the construction shown in FIG. 18. Each of outer layer sheets 820, 830, 840, 850 has a width T of 150 mm. The outer layer sheets 820, 830 and 840, 850 are arranged on both sides of an inner layer sheet 810. Further, 70 g/m$^2$ spunbond nonwoven fabrics 860, 870 having a width K of 20 mm are arranged 20 to 40 mm away from the end of the sheet in the width direction.

In comparative example 7, a first part 800*a*1 (800*c*1) having a width of 20 mm from the end of the sheet in the width direction has a two-layer structure having the outer layer sheets 820, 830 (840, 850). A second part 800*a*2 (800*c*2) extending in the range of 20 to 40 mm from the end of the sheet in the width direction has a three-layer structure having the outer layer sheets 820, 830 (840, 850) and the 70 g/m$^2$ spunbond nonwoven fabric 860 (870). Further, the CD direction of the outer layer sheets 820, 830, 840, 850 coincide with the width direction of the sheet (the horizontal direction in FIG. 18).

According to the comparative example 7, the first member X has the elongation rate of 1.00 mm/N, and the second member Y has the elongation rate of 0.06 mm/N.

Energy (J) required to remove the sheets according to embodiments 1 to 4 and comparative examples 1 to 7 from the holding pieces 121 of the head 110 was measured under the following conditions.

(1) Part of a specimen is pushed in between the holding pieces 121 of the fixed head. At this time, an artificial finger is used in order to make the amount of pushing in the specimen constant.

(2) Then a predetermined point of the specimen held by the holding pieces 121 of the head is pulled. Upon removal of the specimen from the holding pieces 121, the tensile stress is measured.

(3) This measurement is made on several pieces of the same specimen.

As a result, energy of 0.09 to 0.20 J is required to remove the sheets of embodiments 1 to 4 from the holding pieces 121, while energy of 0.01 to 0.05 J is required to remove the sheets of comparative examples 1 to 7 from the holding pieces 121. In embodiments 1 to 4, it is set such that the elongation rate of the first member X<the elongation rate of the second member Y. In comparative examples 1 to 3, it is set such that the elongation rate of the first member X=the elongation rate of the second member Y. In comparative examples 4 to 7, it is set such that the elongation rate of the first member X>the elongation rate of the second member Y.

From the measurements, it has been found that, by making the elongation rate of the first member X lower than the elongation rate of the second member Y, the cleaning sheet 200 can be effectively prevented from becoming detached from the holding pieces 121 of the head 110 during cleaning operation.

As described above, in the outer layer sheet arranged on the both sides of the inner layer sheet (impregnated element) in the cleaning sheet of this embodiment, a fusion bonded layer is formed on the side (inner side) of the outer layer sheet which faces the inner layer sheet. With this construction, the amount of the cleaning solution which is released from the impregnated element to the outer layer sheet is controlled. Therefore, during cleaning operation (when a load is put on the surface of the cleaning sheet), an appropriate amount of the cleaning solution can be released from the surface of the cleaning sheet.

Further, the inner layer sheet and the outer layer sheets are bonded at the edges of the inner layer sheet, and a space is formed between the inner layer sheet and the outer layer sheets. With this construction, the amount of the cleaning solution which is released from the inner layer sheet to the outer layer sheets via the bonded portions can be controlled.

Further, each of the ends of the cleaning sheet has a first part having a lower elongation rate and a second part having a higher elongation rate, and the boundary between the first part and the second part is held by the holding pieces. With this construction, the ends of the cleaning sheet 200 can be effectively prevented from becoming detached from the holding members 120 (holding pieces 121) of the head 110 during cleaning operation.

In order to form a region having a higher elongation rate, in this embodiment, sheet elements stacked in layer are bonded together by hot embossing. A method of changing the elongation rate is not limited to this. For example, the sheet elements stacked in layer can be bonded together by using methods other than hot embossing. Further, when manufacturing a nonwoven fabric sheet (spun lace nonwoven fabric sheet) by a water jet method (hydroentangling method), the elongation rate of a region of the sheet may be increased by closing the nozzle in such a manner as to render the region out of reach of the water jet, or the elongation rate may be changed by changing the constitution of raw cotton.

The constructions that have been described in the above embodiment can be used singly or in combination of appropriately selected ones of them.

Further, in this embodiment, the cleaning sheet is described as a wet sheet which is impregnated with cleaning solution so as to be used for cleaning in a wetted state, but it may be designed as a dry sheet which is not impregnated with cleaning solution so as to be used for cleaning in a dry state.

The constructions of the cleaning sheet is not limited to those described in the above-described embodiment, but rather, may be added to, changed, replaced with alternatives or otherwise modified.

Further, the following aspects can be provided:

"The outer layer sheet is formed of fibers containing thermoplastic fibers, and thermoplastic fibers provided on a side of the outer layer sheet facing the inner layer sheet have a lower melting point than thermoplastic fibers provided on the side opposite from the side facing the inner layer sheet."

"The inner layer sheet and the outer layer sheets are bonded at the edges of the outer layer sheet, and a space is formed in a central portion of the inner sheet between the inner layer sheet and the outer layer sheets."

"The inner layer sheet is centrally located in the cleaning sheet which is placed on the cleaning side (mounting side) of the cleaning sheet mounting member,"

Each cleaning sheet which is described below may also be used singly (without being mounted to the cleaning sheet mounting member of the cleaning tool). Further, the cleaning sheet or the cleaning tool of this invention can be used to clean objects having planar, curved, uneven or stepped shape.

The cleaning sheet which is described below may also be designed to be used in a dry state to clean a cleaning object.

As a cleaning sheet to be used in a wetted state to clean an object, for example, a cleaning sheet having an impregnated element (e.g. inner layer sheet) impregnated with cleaning solution, and outer layer sheets disposed on both sides of the impregnated element is used. In this case, the cleaning region (cleaning area) of an object to be cleaned which can be cleaned by such a cleaning sheet in an appropriate wetted state is determined by the property of releasing the cleaning solution from the outer surfaces of the outer layer sheets. Further, the property of releasing the cleaning solution from the outer surfaces of the outer layer sheets may be determined by the property of releasing the cleaning solution from the impregnated element to the outer layer sheets. Further, the property of releasing the cleaning solution from the impregnated element to the outer layer sheets may be determined by the amount of cleaning solution which can be impregnated into the impregnated element, or the amount of cleaning solution which is released from the impregnated element to the outer layer sheets. In order to control the amount of cleaning solution which is released from the impregnated element to the outer layer sheets, as described above, a space (clearance) may be provided between the impregnated element and the outer layer sheets, or a fusion bonded layer may be formed on the inner sides of the outer layer sheets (facing the impregnated element). An embodiment using a method for controlling the property of releasing cleaning solution from the impregnated element to the outer layer sheets is described above.

DESCRIPTION OF NUMERALS

100 cleaning tool
110 head (cleaning sheet mounting member)
120 holding member
121 holding piece
130 pipe
131 connecting mechanism
150 handle
200, 300, 400, 500, 600, 700, 800 cleaning sheet
200*a*, 200*c*, 300*a*, 300*c*, 400*a*, 400*c*, 500*a*, 500*c*, 600*a*, 600*c*, 700*a*, 700*c*, 800*a*, 800*c* end portion
200*a*1, 200*c*1 first part
200*a*2, 200*c*2 second part
200*a*3, 200*c*3 third part
200P1, 200Q1 first boundary
200P2, 200Q2 second boundary
200*b*, 300*b*, 400*b*, 500*b*, 600*b*, 700*b*, 800*b* central portion (cleaning portion)
201, 202, 220*b*, 230*b* folding line
220*a*, 230*a* folded part
210, 310, 410, 510, 610, 710, 810 inner layer sheet
220, 230, 320, 330, 420, 430, 520, 530, 620, 630, 720, 730, 820, 830 outer layer sheet
221, 231 outer layer
222, 232 inner layer (fusion bonded layer)
203, 204 hot embossed portion

The invention claimed is:

1. A cleaning sheet attachable to a cleaning sheet mounting member comprising:

a central portion which defines a main cleaning area and at least one end portion formed at at least one of both sides of the central portion in a predetermined direction, wherein:

the at least one end portion has a first part having a predetermined first elongation rate and a second part having a predetermined elongation rate higher than the first elongation rate, the second part being disposed between the central portion and the first part in the predetermined direction, wherein the cleaning sheet is detachably held by a cleaning sheet mounting member at a boundary between the first part and the second part; and the second part is formed by a single sheet element or by a plurality of sheet elements stacked and bonded to each other and the first part is formed by sheet elements stacked in layer and bonded to each other, wherein the number of sheet elements in layer of the first part is larger in number than the number of sheet element(s) of the second part, such that the second elongation rate is higher than the first elongation rate.

2. The cleaning sheet according to claim 1, wherein the stacked sheet elements of the first part are bonded together by embossing.

3. The cleaning sheet according to claim 1, wherein the at least one end portion further has a third part having a lower elongation rate than the second part and disposed between the central portion and the second part in the predetermined direction.

4. A cleaning tool with the cleaning sheet mounting member and the cleaning sheet according to claim 1, wherein the cleaning sheet mounting member has a cleaning side to which the central portion is provided and a holding member at which the boundary is detachably held when the cleaning sheet is attached to the cleaning sheet mounting member.

5. The cleaning tool according to claim 4, wherein the holding member has a plurality of elastic holding pieces oppositely provided to each other, wherein the boundary of the cleaning sheet is held by the holding member such that the boundary is pushed to penetrate the holding member through holding pieces and cramped by holding pieces.

* * * * *